US008106570B2

(12) United States Patent
Norling et al.

(10) Patent No.: US 8,106,570 B2
(45) Date of Patent: Jan. 31, 2012

(54) ISOTOPE PRODUCTION SYSTEM AND CYCLOTRON HAVING REDUCED MAGNETIC STRAY FIELDS

(75) Inventors: Jonas Norling, Uppsala (SE); Tomas Eriksson, Uppsala (SE)

(73) Assignee: General Electric Company, Schenectady, NY (US)

( * ) Notice: Subject to any disclaimer, the term of this patent is extended or adjusted under 35 U.S.C. 154(b) by 192 days.

(21) Appl. No.: 12/435,931

(22) Filed: May 5, 2009

(65) Prior Publication Data

US 2010/0283371 A1 Nov. 11, 2010

(51) Int. Cl.
*H05H 13/00* (2006.01)
*H05H 3/06* (2006.01)

(52) U.S. Cl. ..... 313/62; 315/500; 315/502; 376/112; 376/114; 376/108

(58) Field of Classification Search ..... None
See application file for complete search history.

(56) References Cited

U.S. PATENT DOCUMENTS

| | | | |
|---|---|---|---|
| 2,713,635 | A | 7/1955 | Weissenberg et al. |
| 2,872,574 | A | 2/1959 | McMillan et al. |
| 3,175,131 | A | 3/1965 | Burleigh et al. |
| 3,794,927 | A | 2/1974 | Fleischer et al. |
| 3,925,676 | A | 12/1975 | Bigham et al. |
| 4,007,392 | A | 2/1977 | Valfells |
| 4,153,889 | A | 5/1979 | Ikegami |
| 4,288,289 | A | 9/1981 | Landau |
| 5,037,602 | A | 8/1991 | Dabiri et al. |
| 5,139,731 | A | 8/1992 | Hendry |
| 5,463,291 | A | 10/1995 | Carroll et al. |
| 5,874,811 | A | 2/1999 | Finlan et al. |
| 5,917,874 | A | 6/1999 | Schlyer et al. |
| 6,057,655 | A | 5/2000 | Jongen |
| 6,163,006 | A | 12/2000 | Doughty |
| 6,236,055 | B1 | 5/2001 | Williams et al. |
| 6,392,246 | B1 | 5/2002 | Wiberg et al. |

(Continued)

FOREIGN PATENT DOCUMENTS

EP 1485329 A 9/1977

(Continued)

OTHER PUBLICATIONS

V.U. Heidelberger et al., First Experience With the Vacuum System of the Cycloton Comet, PSA Scientific and Technical Report 2004 / vol. VI, pp. 118, 119.

(Continued)

*Primary Examiner* — Natalie Walford
(74) *Attorney, Agent, or Firm* — Dean D. Small; The Small Patent Law Group

(57) ABSTRACT

A cyclotron that includes a magnet yoke that has a yoke body that surrounds an acceleration chamber and a magnet assembly. The magnet assembly is configured to produce magnetic fields to direct charged particles along a desired path. The magnet assembly is located in the acceleration chamber. The magnetic fields propagate through the acceleration chamber and within the magnet yoke. A portion of the magnetic fields escape outside of the magnet yoke as stray fields. The magnet yoke is dimensioned such that the stray fields do not exceed 5 Gauss at a distance of 1 meter from an exterior boundary.

21 Claims, 9 Drawing Sheets

U.S. PATENT DOCUMENTS

| | | | | |
|---|---|---|---|---|
| 6,417,634 | B1 * | 7/2002 | Bergstrom | 315/502 |
| 6,433,495 | B1 | 8/2002 | Wiberg | |
| 6,445,146 | B1 | 9/2002 | Bergstrom et al. | |
| 6,657,188 | B1 | 12/2003 | Hulet et al. | |
| 6,683,426 | B1 | 1/2004 | Kleeven | |
| 6,917,044 | B2 | 7/2005 | Amini | |
| 7,030,399 | B2 | 4/2006 | Williamson et al. | |
| 7,122,966 | B2 | 10/2006 | Norling | |
| 7,394,081 | B2 | 7/2008 | Okazaki et al. | |
| 7,541,905 | B2 * | 6/2009 | Antaya | 335/216 |
| 7,728,311 | B2 * | 6/2010 | Gall | 250/492.21 |
| 2005/0084055 | A1 | 4/2005 | Alvord et al. | |
| 2005/0283199 | A1 | 12/2005 | Norling et al. | |
| 2006/0015864 | A1 | 1/2006 | Kang | |
| 2006/0017411 | A1 * | 1/2006 | Hamm | 315/505 |
| 2006/0104401 | A1 | 5/2006 | Jongen | |
| 2007/0171015 | A1 | 7/2007 | Antaya | |
| 2007/0176699 | A1 | 8/2007 | Iida et al. | |
| 2008/0023645 | A1 | 1/2008 | Amelia et al. | |
| 2008/0067413 | A1 | 3/2008 | Nutt | |
| 2008/0089460 | A1 * | 4/2008 | Sved | 376/195 |
| 2008/0093567 | A1 * | 4/2008 | Gall | 250/493.1 |
| 2008/0240330 | A1 | 10/2008 | Holden | |
| 2008/0258653 | A1 | 10/2008 | Nutt | |
| 2009/0200483 | A1 * | 8/2009 | Gall et al. | 250/396 R |
| 2010/0282978 | A1 * | 11/2010 | Norling et al. | 250/396 ML |
| 2010/0282979 | A1 * | 11/2010 | Norling et al. | 250/396 ML |
| 2010/0283371 | A1 | 11/2010 | Norling et al. | |
| 2010/0329406 | A1 * | 12/2010 | Norling et al. | 376/112 |

FOREIGN PATENT DOCUMENTS

| | | |
|---|---|---|
| GB | 645758 | 11/1950 |
| GB | 756872 | 9/1956 |
| JP | 0223740 | 8/2002 |
| JP | 0512790 | 5/2005 |
| RU | 2278431 | 1/2006 |
| WO | 2006007277 | 1/2006 |
| WO | 2006012467 | 2/2006 |
| WO | 2006015864 | 2/2006 |

OTHER PUBLICATIONS

Bruce F. Milton, Commercial Compact Cyclotrons in the 90'S, TRIUMF, 4004 Westbrook Mall, Vancouver, B.C. Canada V6T 2A3, 8 pgs.

K. Strijckmans, The Isochronous Cyclotron: Principles and Recent Developments, Computerized Medical Imaging and Graphics, 25 (2001) 69-78, www.elsevier.com/locate/compmedimag.

E. Hartwig, "The AEG Compact Cyclotron", Proceedings of the Fifth International Cyclotron Conference, Jan. 1, 1971, pp. 564-572, Butterworths, London, XP002599602.

A.I. Papash, et al., "Commercial Cyclotrons. Part I: Commercial Cyclotrons in the Energy Range 10-30 MeV for Isotope Production", Physics of Particles and Neclei 2008, vol. 39 No. 4 pp. 597-631, 2008, Russia, XP002599603.

H. Okuno, et al., "The Superconducting Ring Cyclotron in RIKEN", IEEE Transactions on Applied Superconductivity IEEE USA, vol. 17 No. 2 pp. 1063-1068, Jun. 2007, Japan, XP002599833.

Berridge, MS et al; High Yield 0-18 Water Target for F-18 Production on MC-17 Cyclotrons, 4 pgs., 2002.

Chouhan, et al; Design of Superferric Magnet for the Cyclotron Gas Stopper Project At the NSCL*; Proceedings of PAC07, Albuquerque, New Mexico, USA, 1-4244-0917-9/07 c 2007 IEEE.

Electron and Gamma Bremsstrahlung Beams of JINR and CTU Microtrons. Belov A.G. (JINR, Dubna) Chvatil D. et al; 1 pg., 2000.

Hichwa, RD et al; Design of Target Systems for Production of PET Nuclides; Division of Nuclear Medicine 1989, 4pgs.

International Search Report and Written Opinion issued in connection with PCT/US2010/1028090, Sep. 20, 2010.

International Search Report and Written Opinion issued in connection with PCT/US2010/1037258, Oct. 14, 2010.

Kalt, U et al; Vacuum System of the Proscan Cyclotron Comet; PSI Scientific and Technical Report 2002, vol. 6, 1 pg.

Kjellstrom, R. et al; MC32 Multiparticle Negative ION Cyclotron; Nuclear Medicine Division, 6 pgs., 1989.

Marks, Steve; Magnetic Design of Trim Exitations for the Advanced Light Source Storage Ring Sextupole*, Jun. 1995, 8 pgs.

Michelato, P. et al; Operational Experience of the K800 Cyclotron Vacuum System at LNS; 3 pgs., 1992.

Ohnishi, J. et al; the Magnetic Field of the Superconducting Ring Cyclotron, 3 pgs., 2007.

Y. Jongen & Ryckewaert, "Preliminary Design for a 30 Mev, 500 MicroA H-Cyclotron" IEEE Transactions on Nuclear Science, vol. NS-32, No. 5, Oct. 1985, pp. 2703-2705.

International Search Report and Written Opinion issued in connection with PCT/US2010/1031394, Sep. 21, 2010.

* cited by examiner

ISOTOPE PRODUCTION SYSTEM AND CYCLOTRON HAVING REDUCED MAGNETIC STRAY FIELDS

CROSS-REFERENCES TO RELATED APPLICATIONS

The present application includes subject matter related to subject matter disclosed in patent applications having Ser. No. 12/435,903 entitled "ISOTOPE PRODUCTION SYSTEM AND CYCLOTRON," and Ser. No. 12/435,949 entitled "ISOTOPE PRODUCTION SYSTEM AND CYCLOTRON HAVING A MAGNET YOKE WITH A PUMP ACCEPTANCE CAVITY," filed contemporaneously with the present application, both of which are incorporated by reference in their entirety.

BACKGROUND OF THE INVENTION

Embodiments of the invention relate generally to cyclotrons, and more particularly to cyclotrons used to produce radioisotopes.

Radioisotopes (also called radionuclides) have several applications in medical therapy, imaging, and research, as well as other applications that are not medically related. Systems that produce radioisotopes typically include a particle accelerator, such as a cyclotron, that has a magnet yoke that surrounds an acceleration chamber and includes opposing poles spaced apart from each other. The cyclotron uses electrical and magnetic fields to accelerate and guide charged particles along a spiral-like orbit between the poles. To generate isotopes, the cyclotron forms a beam of the charged particles and directs the beam out of the acceleration chamber so that it is incident upon a target material. During operation of the cyclotron, the magnetic fields generated within the magnet yoke are very strong. For example, in some cyclotrons, the magnetic field between the poles is at least one Tesla.

However, the magnetic fields generated by the cyclotron may produce stray fields. Stray fields are those magnetic fields that escape from the magnet yoke of the cyclotron into regions where the magnetic fields are not desired. For example, during operation of a cyclotron, strong stray fields can be produced within several meters of the magnet yoke. These stray fields may negatively affect equipment of the cyclotron or other system devices nearby. Furthermore, the stray fields may be dangerous for those people around the cyclotron who have a pacemaker or some other biomedical device.

In addition to magnetic stray fields, the cyclotron may produce undesirable levels of radiation within a certain distance of the cyclotron. Ions within the chamber may collide with gas particles therein and become neutral particles that are no longer affected by the electrical and magnetic fields within the acceleration chamber. The neutral particles may collide with the walls of the acceleration chamber and produce secondary gamma radiation.

In some conventional cyclotrons and isotope production systems, the challenges of stray fields and radiation have been addressed by adding a large amount of shielding that surrounds the cyclotron or by placing the cyclotron in specifically designed rooms. However, additional shielding can be expensive and designing specific rooms for cyclotrons raises new challenges, especially for pre-existing rooms that were not originally intended for radioisotope production.

Accordingly, there is a need for improved methods, cyclotrons, and isotope production systems that reduce nearby magnetic stray fields. There is also a need for improved methods, cyclotrons, and isotope production systems that reduce a level of radiation emitted by the cyclotron.

BRIEF DESCRIPTION OF THE INVENTION

In accordance with another embodiment, a cyclotron is provided that includes a magnet yoke that has a yoke body that surrounds an acceleration chamber and a magnet assembly. The magnet assembly is configured to produce magnetic fields to direct charged particles along a desired path. The magnet assembly is located in the acceleration chamber. The magnetic fields propagate through the acceleration chamber and within the magnet yoke. A portion of the magnetic fields escape outside of the magnet yoke as stray fields. The magnet yoke is dimensioned such that the stray fields do not exceed 5 Gauss at a distance of 1 meter from an exterior boundary.

In accordance with another embodiment, a method of manufacturing a cyclotron is provided. The cyclotron is configured to generate magnetic and electric fields for directing charged particles along a desired path. The method includes providing a magnet yoke having a yoke body that surrounds an acceleration chamber. The magnetic fields are generated therein to direct the charged particles. The magnet yoke is dimensioned such that stray fields escaping the magnet yoke do not exceed a predetermined amount at a predetermined distance from an exterior boundary. The method also includes locating a magnet assembly in the acceleration chamber. The magnet assembly is configured to produce the magnetic fields. The magnet assembly is configured to operate and the magnet yoke is dimensioned so that the stray fields do not exceed 5 Gauss at a distance of 1 meter from the exterior boundary.

DETAILED DESCRIPTION OF THE INVENTION

Figure 1:
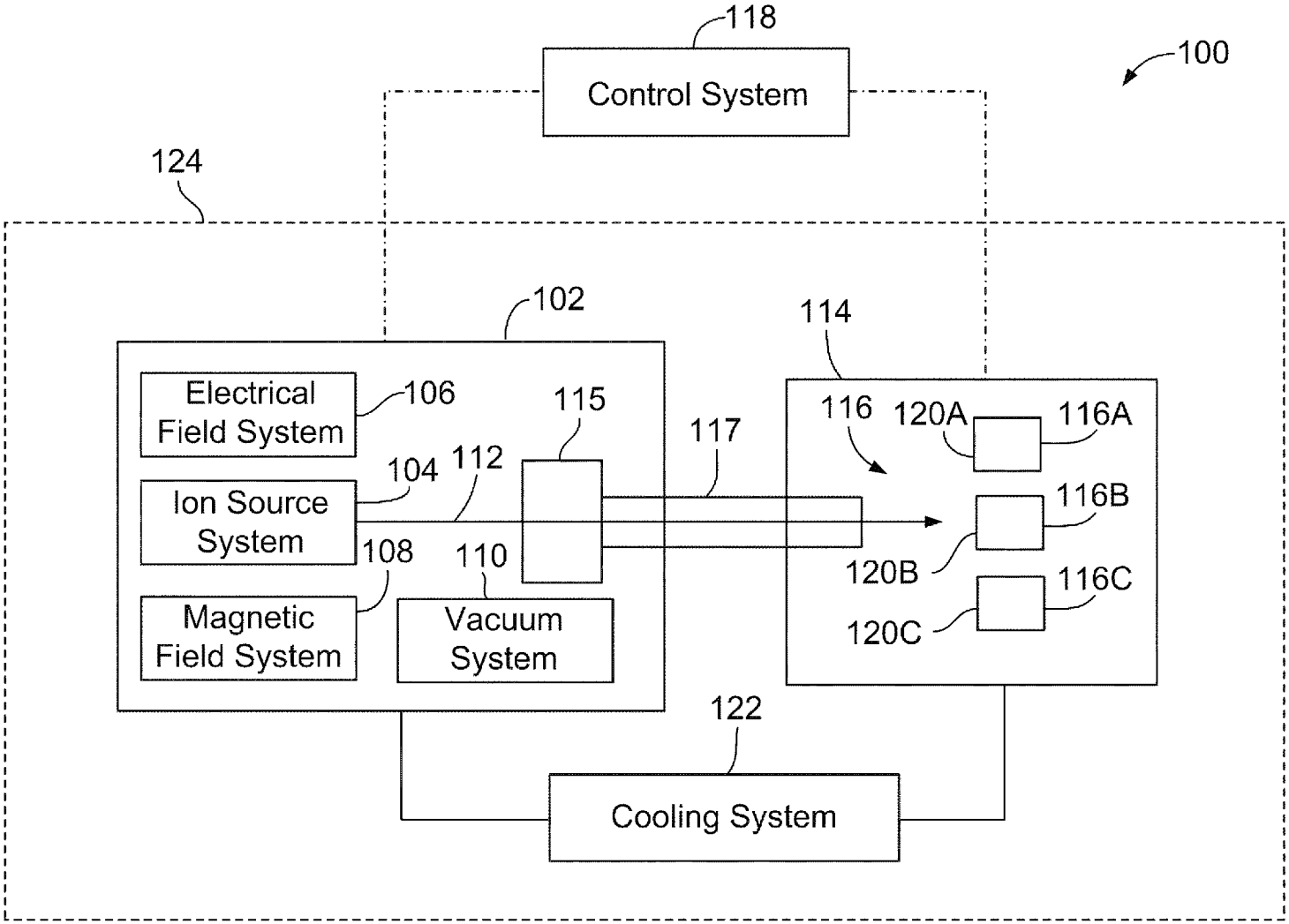
FIG. 1 is a block diagram of an isotope production system formed in accordance with one embodiment.

FIG. 1 is a block diagram of an isotope production system 100 formed in accordance with one embodiment. The system 100 includes a cyclotron 102 that has several sub-systems including an ion source system 104, an electrical field system 106, a magnetic field system 108, and a vacuum system 110. During use of the cyclotron 102, charged particles are placed within or injected into the cyclotron 102 through the ion source system 104. The magnetic field system 108 and electrical field system 106 generate respective fields that cooperate with one another in producing a particle beam 112 of the charged particles. The charged particles are accelerated and guided within the cyclotron 102 along a predetermined path. The system 100 also has an extraction system 115 and a target system 114 that includes a target material 116.

To generate isotopes, the particle beam 112 is directed by the cyclotron 102 through the extraction system 115 along a beam transport path 117 and into the target system 114 so that the particle beam 112 is incident upon the target material 116 located at a corresponding target area 120. The system 100 may have multiple target areas 120A-C where separate target materials 116A-C are located. A shifting device or system (not shown) may be used to shift the target areas 120A-C with respect to the particle beam 112 so that the particle beam 112 is incident upon a different target material 116. A vacuum may be maintained during the shifting process as well. Alternatively, the cyclotron 102 and the extraction system 115 may not direct the particle beam 112 along only one path, but may direct the particle beam 112 along a unique path for each different target area 120A-C.

Examples of isotope production systems and/or cyclotrons having one or more of the sub-systems described above are described in U.S. Pat. Nos. 6,392,246; 6,417,634; 6,433,495; and 7,122,966 and in U.S. Patent Application Publication No. 2005/0283199, all of which are incorporated by reference in their entirety. Additional examples are also provided in U.S. Pat. Nos. 5,521,469; 6,057,655; and in U.S. Patent Application Publication Nos. 2008/0067413 and 2008/0258653, all of which are incorporated by reference in their entirety.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, the system 100 may generate protons to make $^{18}F^-$ isotopes in liquid form, $^{11}C$ isotopes as $CO_2$, and $^{13}N$ isotopes as $NH_3$. The target material 116 used to make these isotopes may be enriched $^{18}O$ water, natural $^{14}N_2$ gas, and $^{16}O$-water. The system 100 may also generate deuterons in order to produce $^{15}O$ gases (oxygen, carbon dioxide, and carbon monoxide) and $^{15}O$ labeled water.

In some embodiments, the system 100 uses $^1H^-$ technology and brings the charged particles to a low energy (e.g., about 7.8 MeV) with a beam current of approximately 10-30 μA. In such embodiments, the negative hydrogen ions are accelerated and guided through the cyclotron 102 and into the extraction system 115. The negative hydrogen ions may then hit a stripping foil (not shown) of the extraction system 115 thereby removing the pair of electrons and making the particle a positive ion, $^1H^+$. However, in alternative embodiments, the charged particles may be positive ions, such as $^1H^+$, $^2H^+$, and $^3He^+$. In such alternative embodiments, the extraction system 115 may include an electrostatic deflector that creates an electric field that guides the particle beam toward the target material 116.

The system 100 may include a cooling system 122 that transports a cooling or working fluid to various components of the different systems in order to absorb heat generated by the respective components. The system 100 may also include a control system 118 that may be used by a technician to control the operation of the various systems and components. The control system 118 may include one or more user-interfaces that are located proximate to or remotely from the cyclotron 102 and the target system 114. Although not shown in FIG. 1, the system 100 may also include one or more radiation and/or magnetic shields for the cyclotron 102 and the target system 114.

The system 100 may produce the isotopes in predetermined amounts or batches, such as individual doses for use in medical imaging or therapy. A production capacity for the system 100 for the exemplary isotope forms listed above may be 50 mCi in less than about ten minutes at 20 μA for $^{18}F^-$; 300 mCi in about thirty minutes at 30 μA for $^{11}CO_2$; and 100 mCi in less than about ten minutes at 20 μA for $^{13}NH_3$.

Also, the system 100 may use a reduced amount of space with respect to known isotope production systems such that the system 100 has a size, shape, and weight that would allow the system 100 to be held within a confined space. For example, the system 100 may fit within pre-existing rooms that were not originally built for particle accelerators, such as in a hospital or clinical setting. As such, the cyclotron 102, the extraction system 115, the target system 114, and one or more components of the cooling system 122 may be held within a common housing 124 that is sized and shaped to be fitted into a confined space. As one example, the total volume used by the housing 124 may be 2 $m^3$. Possible dimensions of the housing 124 may include a maximum width of 2.2 m, a maximum height of 1.7 m, and a maximum depth of 1.2 m. The combined weight of the housing and systems therein may be approximately 10000 kg. The housing 124 may be fabricated from polyethylene (PE) and lead and have a thickness configured to attenuate neutron flux and gamma rays from the cyclotron 102. For example, the housing 124 may have a thickness (measured between an inner surface that surrounds the cyclotron 102 and an outer surface of the housing 124) of at least about 100 mm along predetermined portions of the housing 124 that attenuate the neutron flux.

The system 100 may be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. In particular embodiments, the system 100 accelerates the charged particles to an energy of approximately 9.6 MeV or less. In more particular embodiments, the system 100 accelerates the charged particles to an energy of approximately 7.8 MeV or less.

Figure 2:
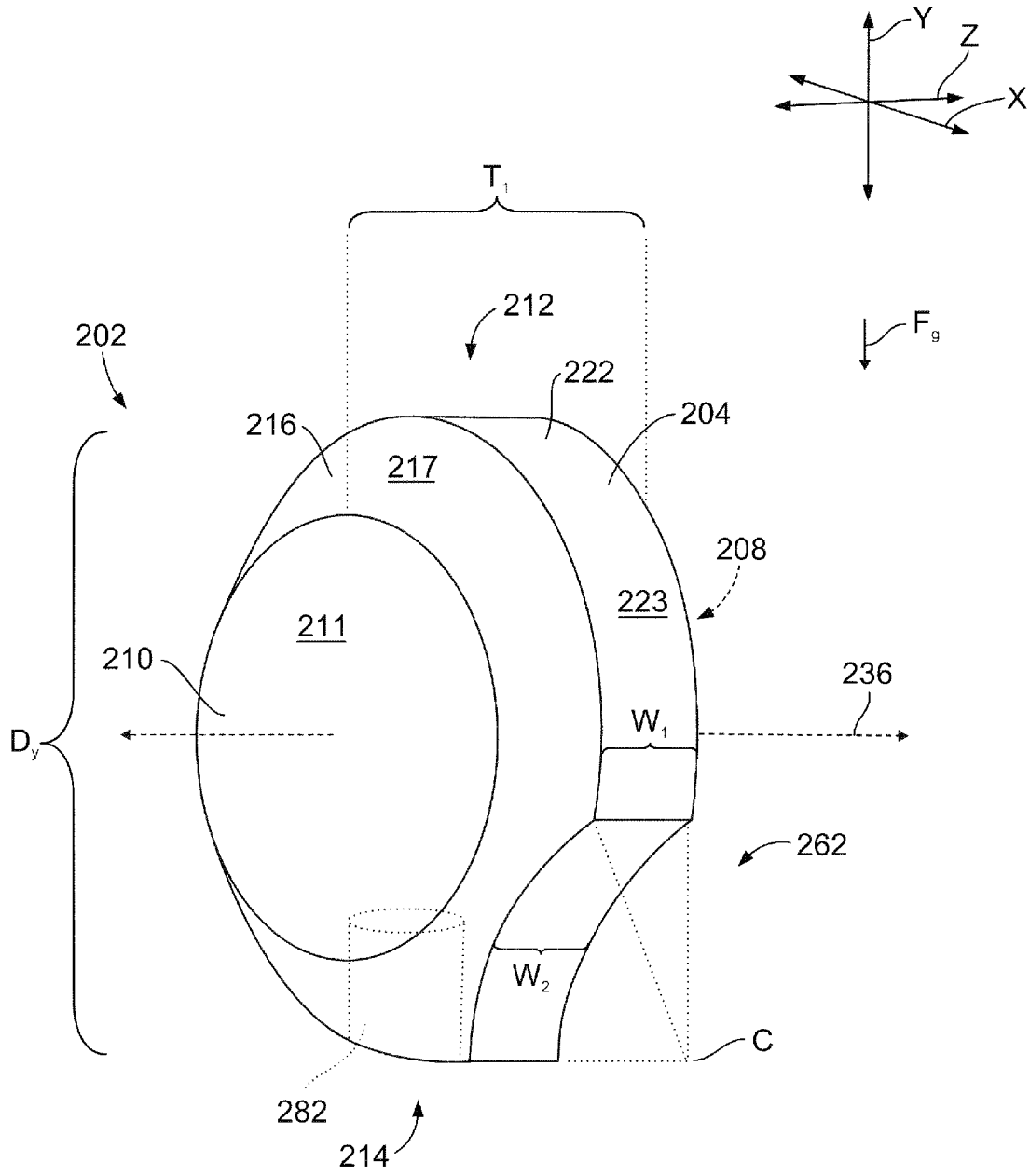
FIG. 2 is a perspective view of a magnet yoke formed in accordance with one embodiment.

FIG. 2 is a perspective view of a magnet yoke 202 formed in accordance with one embodiment. The magnet yoke 202 is oriented with respect to X, Y, and Z-axes. In some embodiments, the magnet yoke 202 is oriented vertically with respect to the gravitational force $F_g$. The magnet yoke 202 has a yoke body 204 that may be substantially circular about a central axis 236 that extends through a center of the yoke body 204 parallel to the Z-axis. The yoke body 204 may be manufactured from iron and/or another ferromagnetic material and may be sized and shaped to produce a desired magnetic field.

Figure 3:
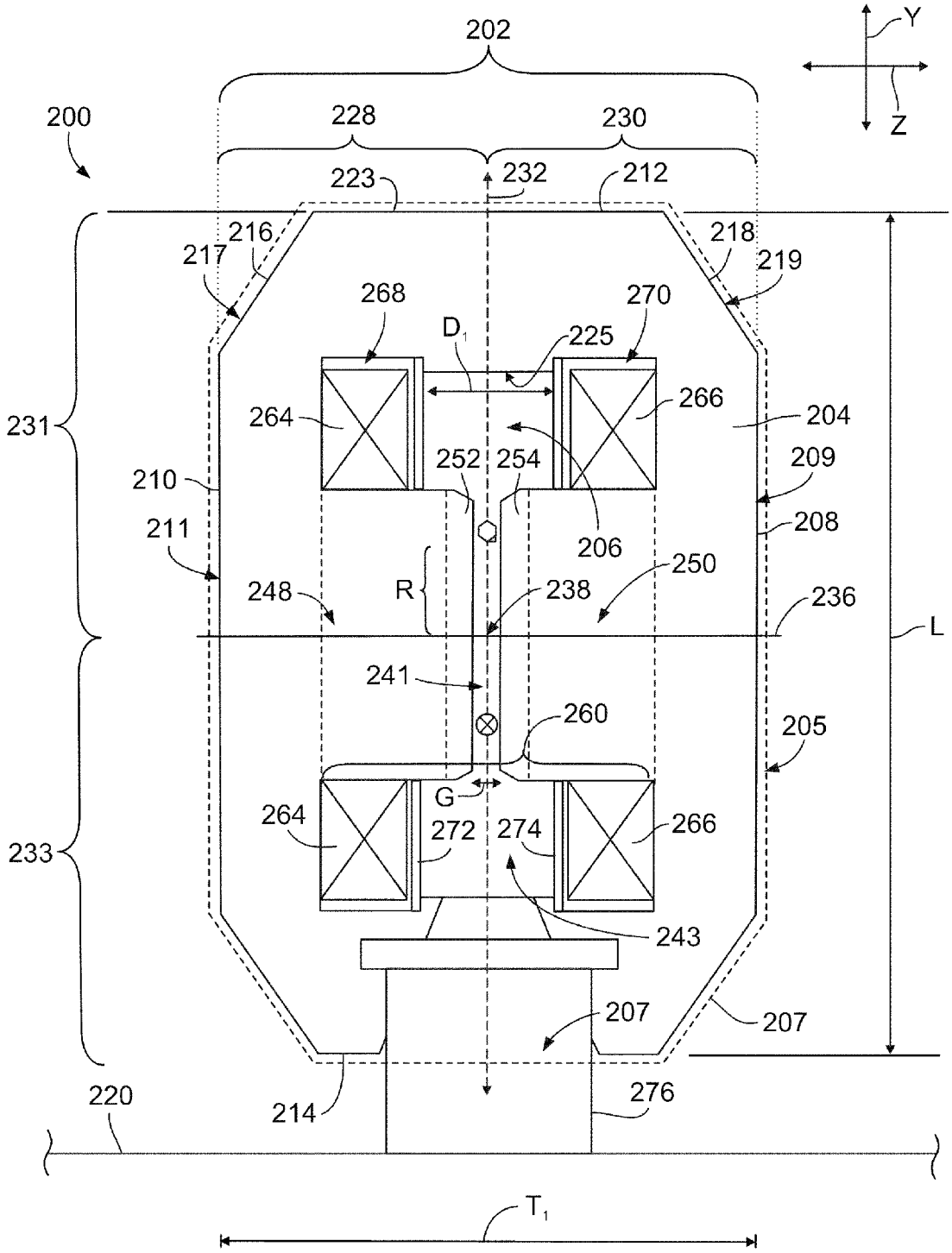
FIG. 3 is a side view of a cyclotron formed in accordance with one embodiment.

The yoke body 204 has a radial portion 222 that curves circumferentially about the central axis 236. The radial portion 222 has an outer radial surface 223 that extends a width $W_1$. The width $W_1$ of the radial surface 223 may extend in an axial direction along the central axis 236. When the yoke body 204 is oriented vertically, the radial portion 222 may have top and bottom ends 212 and 214 with a diameter $D_Y$ of the yoke body 204 extending therebetween. The yoke body 204 may also have opposing sides 208 and 210 that are separated by a thickness $T_1$ of the yoke body 204. Each side 208 and 210 has a corresponding side surface 209 and 211, respectively (side surface 209 is shown in FIG. 3). The side surfaces 209 and 211 may extend substantially parallel to each other and may be substantially planar (i.e., along a plane formed by the X and Y axes). The radial portion 222 is connected to the sides 208 and 210 through corners or transition regions 216 and 218 that have corner surfaces 217 and 219, respectively. (The transition region 218 and the corner surface 219 are shown in FIG. 3.) The corner surfaces 217 and 219 extend from the radial surface 223 away from each other and toward the central axis 236 to corresponding side surfaces 211 and 209. The radial surface 223, the side surfaces 209 and 211, and the corner surfaces 217 and 219 collectively form an exterior surface 205 (FIG. 3) of the yoke body 204.

The yoke body 204 may have several cut-outs, recesses, or passages that lead into the yoke body 204. For example, the yoke body 204 may have a shield recess 262 that is sized and shaped to receive a radiation shield for a target assembly (not shown). As shown, the shield recess 262 has a width $W_2$ that extends along the central axis 236. The shield recess 262 curves inward toward the central axis 236 through the thickness $T_1$. As such, the width $W_1$ is less than the width $W_2$. Also, the shied recess 262 may have a radius of curvature having a center (indicated as a point C) that is outside of the exterior surface 205. The point C may represent an approximate location of a target. Alternatively, the shield recess 262 may have other dimensions. Also shown, the yoke body 204 may form a pump acceptance (PA) cavity 282 that is sized and shaped to receive a vacuum pump (not shown).

FIG. 3 is a side view of a cyclotron 200 formed in accordance with one embodiment. The cyclotron 200 includes the magnet yoke 202. As shown, the yoke body 204 may be divided into opposing yoke sections 228 and 230 that define an acceleration chamber 206 therebetween. The yoke sections 228 and 230 are configured to be positioned adjacent to one another along a mid-plane 232 of the magnet yoke 202. The cyclotron 200 may rest upon a horizontal platform 220 that is configured to support the weight of the cyclotron 200 and may be, for example, a floor of a room or a slab of cement. The central axis 236 extends between and through the yoke sections 228 and 230 (and corresponding sides 210 and 208, respectively). The central axis 236 extends perpendicular to the mid-plane 232 through a center of the yoke body 204. The acceleration chamber 206 has a central region 238 located at an intersection of the mid-plane 232 and the central axis 236. In some embodiments, the central region 238 is at a geometric center of the acceleration chamber 206. Also shown, the magnet yoke 202 includes an upper portion 231 extending above the central axis 236 and a lower portion 233 extending below the central axis 236.

The yoke sections 228 and 230 include poles 248 and 250, respectively, that oppose each other across the mid-plane 232 within the acceleration chamber 206. The poles 248 and 250 may be separated from each other by a pole gap G. The pole gap G is sized and shaped to produce a desired magnetic field when the cyclotron 200 is in operation. Furthermore, the pole gap G may be sized and shaped based upon a desired conductance for removing particles within the acceleration chamber. As an example, in some embodiments, the pole gap G may be 3 cm.

The pole 248 includes a pole top 252 and the pole 250 includes a pole top 254 that faces the pole top 252. In the illustrated embodiment, the cyclotron 200 is an isochronous cyclotron where the pole tops 252 and 254 each form an arrangement of sectors of hills and valleys (not shown). The hills and the valleys interact with each other to produce a magnetic field for focusing the path of the charged particles. One of the yoke sections 228 or 230 may also include radio frequency (RF) electrodes (not shown) that include hollow dees located within the corresponding valleys. The RF electrodes cooperate with each other and form a resonant system that includes inductive and capacitive elements tuned to a predetermined frequency (e.g., 100 MHz). The RF electrode system may have a high frequency power generator (not shown) that may include a frequency oscillator in communication with one or more amplifiers. The RF electrode system creates an alternating electrical potential between the RF electrodes.

The cyclotron 200 also includes a magnet assembly 260 located within or proximate the acceleration chamber 206. The magnet assembly 260 is configured to facilitate producing the magnetic field with the poles 248 and 250 to direct charged particles along a desired path. The magnet assembly 260 includes an opposing pair of magnet coils 264 and 266 that are spaced apart from each other across the mid-plane 232 at a distance $D_1$. The magnet coils 264 and 266 may be, for example, copper alloy resistive coils. Alternatively, the magnet coils 264 and 266 may be an aluminum alloy. The magnet coils may be substantially circular and extend about the central axis 236. The yoke sections 228 and 230 may form magnet coil cavities 268 and 270, respectively, that are sized and shaped to receive the corresponding magnet coils 264 and 266, respectively. Also shown in FIG. 3, the cyclotron 200 may include chamber walls 272 and 274 that separate the magnet coils 264 and 266 from the acceleration chamber 206 and facilitate holding the magnet coils 264 and 266 in position.

The acceleration chamber 206 is configured to allow charged particles, such as $^1H^-$ ions, to be accelerated therein along a predetermined curved path that wraps in a spiral manner about the central axis 236 and remains substantially along the mid-plane 232. The charged particles are initially positioned proximate to the central region 238. When the cyclotron 200 is activated, the path of the charged particles may orbit around the central axis 236. In the illustrated embodiment, the cyclotron 200 is an isochronous cyclotron and, as such, the orbit of the charged particles has portions that curve about the central axis 236 and portions that are more linear. However, embodiments described herein are not limited to isochronous cyclotrons, but also includes other types of cyclotrons and particle accelerators. As shown in FIG. 3, when the charged particles orbit around the central axis 236, the charged particles may project out of the page in the upper portion 231 of the acceleration chamber 206 and extend into the page in the lower portion 233 of the acceleration chamber 206. As the charged particles orbit around the central axis 236, a radius R that extends between the orbit of the charged particles and the central region 238 increases. When the charged particles reach a predetermined location along the orbit, the charged particles are directed into or through an extraction system (not shown) and out of the cyclotron 200.

The acceleration chamber 206 may be in an evacuated state before and during the forming of the particle beam 112. For example, before the particle beam is created, a pressure of the acceleration chamber 206 may be approximately $1\times10^{-7}$ millibars. When the particle beam is activated and $H_2$ gas is flowing through an ion source (not shown) located at the central region 238, the pressure of the acceleration chamber 206 may be approximately $2\times10^{-5}$ millibar. As such, the cyclotron 200 may include a vacuum pump 276 that may be proximate to the mid-plane 232. The vacuum pump 276 may include a portion that projects radially outward from the end 214 of the yoke body 204. As will discussed in greater detail below, the vacuum pump 276 may include a pump that is configured to evacuate the acceleration chamber 206.

Figure 8:
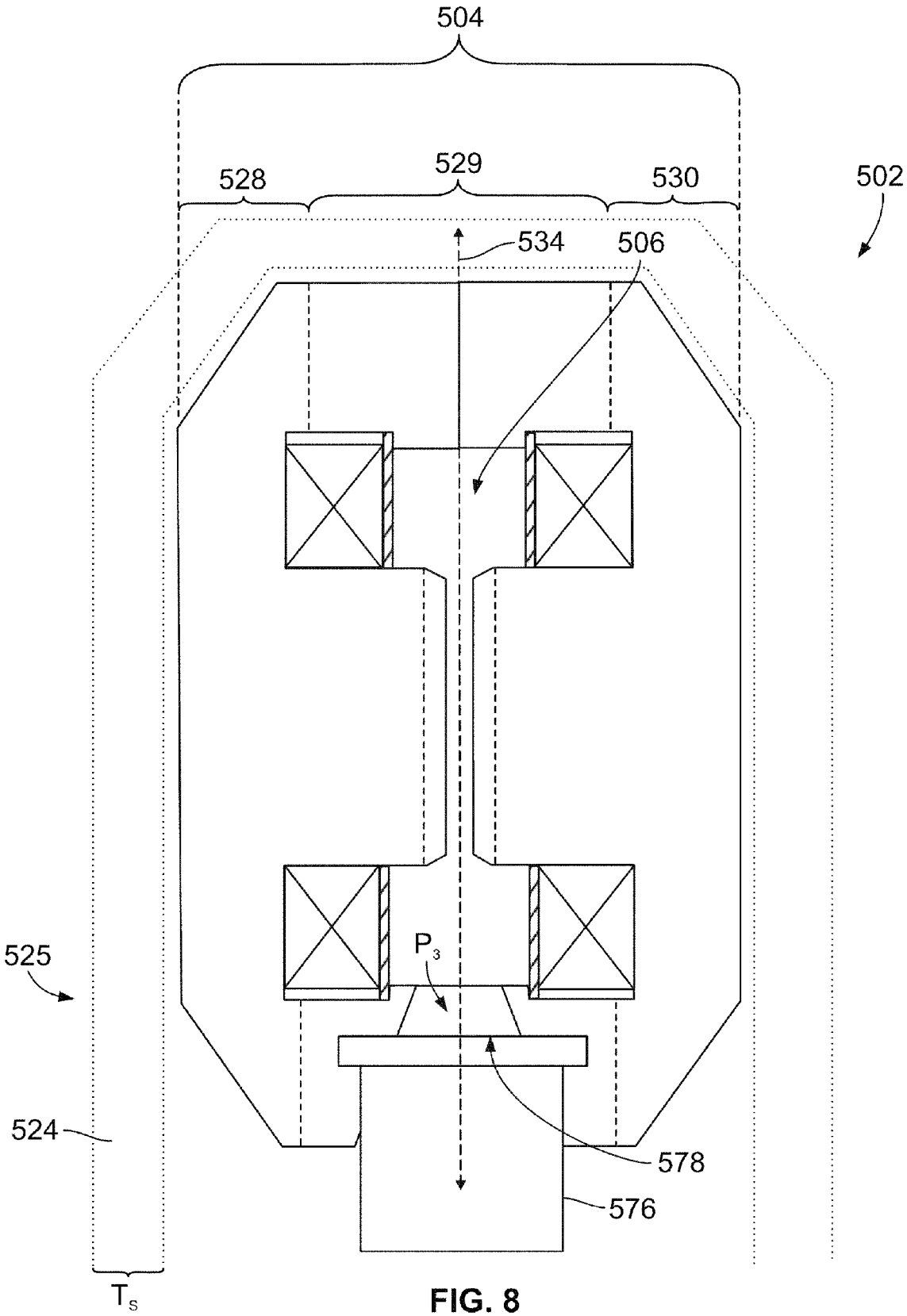
FIG. 8 is a side cross-section of a cyclotron formed in accordance with another embodiment that may be used with the isotope production system shown in FIG. 6.

In some embodiments, the yoke sections 228 and 230 may be moveable toward and away from each other so that the acceleration chamber 206 may be accessed (e.g., for repair or maintenance). For example, the yoke sections 228 and 230 may be joined by a hinge (not shown) that extends alongside the yoke sections 228 and 230. Either or both of the yoke sections 228 and 230 may be opened by pivoting the corresponding yoke section(s) about an axis of the hinge. As another example, the yoke sections 228 and 230 may be separated from each other by laterally moving one of the yoke sections linearly away from the other. However, in alternative embodiments, the yoke sections 228 and 230 may be integrally formed or remain sealed together when the acceleration chamber 206 is accessed (e.g., through a hole or opening of the magnet yoke 202 that leads into the acceleration chamber 206). In alternative embodiments, the yoke body 204 may have sections that are not evenly divided and/or may include more than two sections. For example, the yoke body may have three sections as shown in FIG. 8 with respect to the magnet yoke 504.

The acceleration chamber 206 may have a shape that extends along and is substantially symmetrical about the mid-plane 232. For instance, the acceleration chamber 206 may be surrounded by an inner radial or wall surface 225 that extends around the central axis 236 such the acceleration chamber 206 is substantially disc-shaped. The acceleration chamber 206 may include inner and outer spatial regions 241 and 243. The inner spatial region 241 may be defined between the pole tops 252 and 254, and the outer spatial region 243 may be defined between the chamber walls 272 and 274. The spatial region 243 extends around the central axis 236 surrounding the spatial region 241. The orbit of the charged particles during operation of the cyclotron 200 may be within the spatial region 241. As such, the acceleration chamber 206 is at least partially defined widthwise by the pole tops 252 and 254 and the chamber walls 272 and 274. An outer periphery of the acceleration chamber may be defined by the radial surface 225. The acceleration chamber 206 may also include passages that lead radially outward away from the spatial region 243, such as a passage $P_1$ (shown in FIG. 4) that leads toward the vacuum pump 276.

The exterior surface 205 defines an envelope 207 of the yoke body 204. The envelope 207 has a shape that is about equivalent to a general shape of the yoke body 204 defined by the exterior surface 205 without small cavities, cut-outs, or recesses. (For illustrative purposes only, the envelope 207 is shown in FIG. 3 as being larger than the yoke body 204.) As shown in FIG. 3, a cross-section of the envelope 207 is an eight-sided polygon defined by the radial surface 223, the side surfaces 209 and 211, and the corner surfaces 217 and 219. The yoke body 204 may form passages, cut-outs, recesses, cavities, and the like that allow component or devices to penetrate into the envelope 207. The shield recess 262 and the PA cavity 282 are examples of such recesses and cavities that allow a corresponding component to penetrate into the envelope 207.

Figure 4:
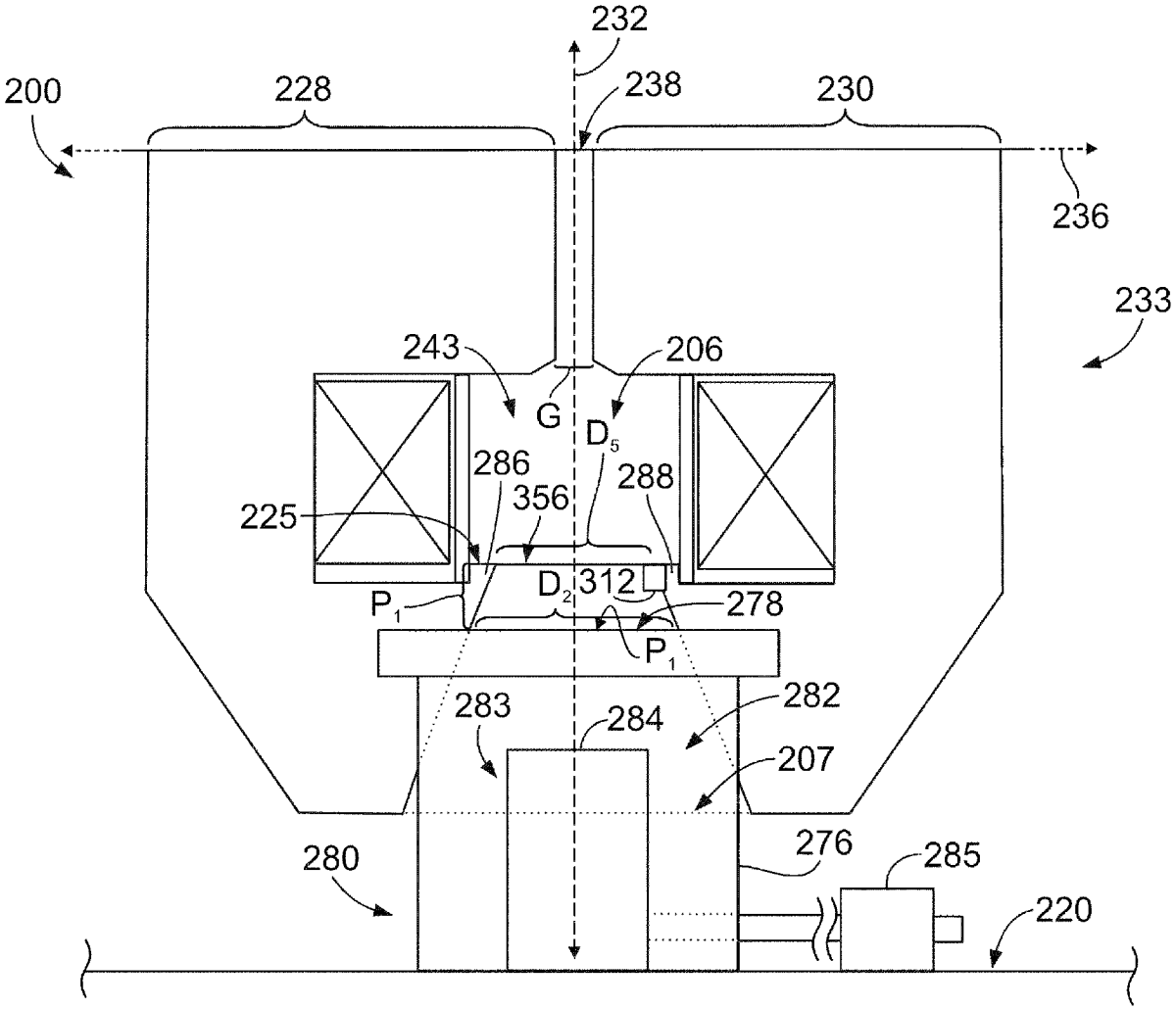
FIG. 4 is a side view of a bottom portion of the cyclotron shown in FIG. 3.

FIG. 4 is an enlarged side cross-section of the cyclotron 200 and, more specifically, the lower portion 233. The yoke body 204 may define a port 278 that opens directly onto the acceleration chamber 206 and, more specifically, the spatial region 243. The vacuum pump 276 may be directly coupled to the yoke body 204 at the port 278. The port 278 provides an entrance or opening into the vacuum pump 276 for undesirable gas particles to flow therethrough. The port 278 may be shaped (along with other factors and dimensions of the cyclotron 200) to provide a desired conductance of the gas particles through the port 278. For example, the port 278 may have a circular, square-like, or another geometric shape.

The vacuum pump 276 is positioned within a pump acceptance (PA) cavity 282 formed by the yoke body 204. The PA cavity 282 is fluidicly coupled to the acceleration chamber 206 and opens onto the spatial region 243 of the acceleration chamber 206 and may include a passage $P_1$. When positioned within the PA cavity 282, at least a portion of the vacuum pump 276 is within the envelope 207 of the yoke body 204 (FIG. 2). The vacuum pump 276 may project radially outward away from the central region 238 or central axis 236 along the mid-plane 232. The vacuum pump 276 may or may not project beyond the envelope of the yoke body 204. By way of example, the vacuum pump 276 may be located between the acceleration chamber 206 and the platform 220 (i.e., the vacuum pump 276 is located directly below the acceleration chamber 206). In other embodiments, the vacuum pump 276 may also project radially outward away from the central region 238 along the mid-plane 232 at another location. For example, the vacuum pump 276 may be above or behind the acceleration chamber 206 in FIG. 3. In alternative embodiments, the vacuum pump 276 may project away from one of the side faces 208 or 210 in a direction that is parallel to the central axis 236. Also, although only one vacuum pump 276 is shown in FIG. 4, alternative embodiments may include multiple vacuum pumps. Furthermore, the yoke body 204 may have additional PA cavities.

The vacuum pump 276 includes a tank wall 280 and a vacuum or pump assembly 283 held therein. The tank wall 280 is sized and shaped to fit within the PA cavity 282 and hold the pump assembly 283 therein. For example, the tank wall 280 may have a substantially circular cross-section as the tank wall 280 extends from the cyclotron 200 to the platform 220. Alternatively, the tank wall 280 may have other cross-sectional shapes. The tank wall 280 may provide enough space therein for the pump assembly 283 to operate effectively. The radial surface 225 may define an opening 356 and the yoke sections 228 and 230 may form corresponding rim portions 286 and 288 that are proximate to the port 278. The rim portions 286 and 288 may define the passage $P_1$ that extends from the opening 356 to the port 278. The port 278 opens onto the passage $P_1$ and the acceleration chamber 206 and has a diameter $D_2$. The opening 356 has a diameter $D_{10}$. The diameters $D_2$ and $D_{10}$ may be configured so that the cyclotron 200 operates at a desired efficiency in producing the radioisotopes. For example, the diameters $D_2$ and $D_{10}$ may be based upon a size and shape of the acceleration chamber 206, including the pole gap G, and an operating conductance of the pump assembly 283. As a specific example, the diameter $D_2$ may be about 250 mm to about 300 mm.

The pump assembly 283 may include one or more pumping devices 284 that effectively evacuates the acceleration chamber 206 so that the cyclotron 200 has a desired operating efficiency in producing the radioisotopes. The pump assembly 283 may include a one or more momentum-transfer type pumps, positive displacement type pumps, and/or other types of pumps. For example, the pump assembly 283 may include a diffusion pump, an ion pump, a cryogenic pump, a rotary vane or roughing pump, and/or a turbomolecular pump. The pump assembly 283 may also include a plurality of one type of pump or a combination of pumps using different types. The pump assembly 283 may also have a hybrid pump that uses different features or sub-systems of the aforementioned pumps. As shown in FIG. 4, the pump assembly 283 may also be fluidicly coupled in series to a rotary vane or roughing pump 285 that may release the air into the surrounding atmosphere.

Furthermore, the pump assembly 283 may include other components for removing the gas particles, such as additional pumps, tanks or chambers, conduits, liners, valves including ventilation valves gauges, seals, oil, and exhaust pipes. In addition, the pump assembly 283 may include or be connected to a cooling system. Also, the entire pump assembly 283 may fit within the PA cavity 282 (i.e., within the envelope 207) or, alternatively, only one or more of the components may be located within the PA cavity 282. In the exemplary embodiment, the pump assembly 283 includes at least one momentum-transfer type vacuum pump (e.g., diffusion pump, or turbomolecular pump) that is located at least partially within the PA cavity 282.

Also shown, the vacuum pump 276 may be communicatively coupled to a pressure sensor 312 within the acceleration chamber 206. When the acceleration chamber 206 reaches a predetermined pressure, the pumping device 284 may be automatically activated or automatically shut-off. Although not shown, there may be additional sensors within the acceleration chamber 206 or PA cavity 282.

Figure 5:
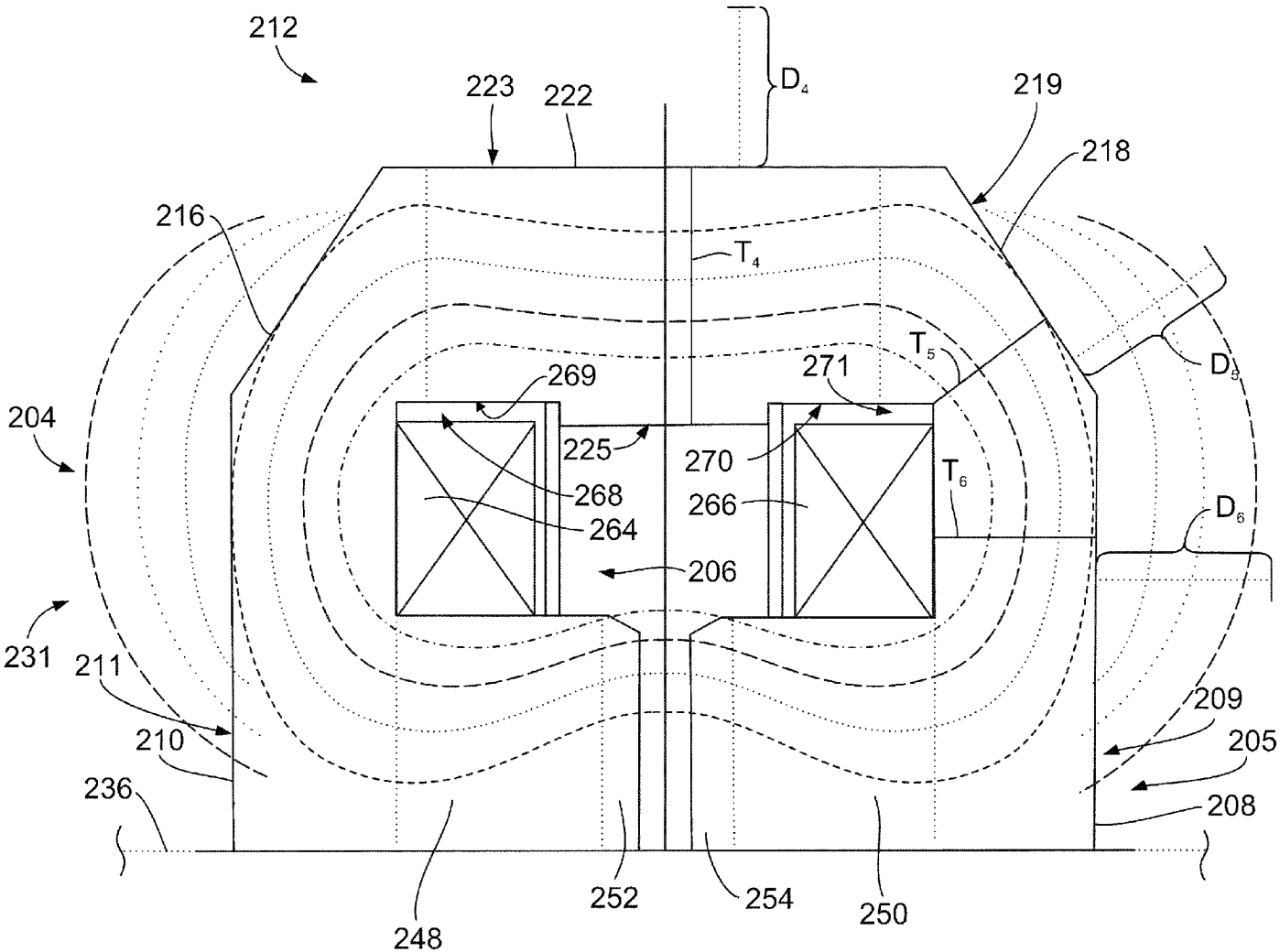
FIG. 5 is a side view of a top portion of the cyclotron in FIG. 3 illustrating magnetic field lines during operation of the cyclotron.

FIG. 5 is a side view of the upper portion 231 illustrating magnetic field lines during operation of the cyclotron 200 (FIG. 3). When the magnet coils 264 and 266 are activated, the cyclotron 200 generates a strong magnetic field between the pole tops 252 and 254. For example, an average magnetic field strength between the pole tops 252 and 254 may be at least 1 Tesla or at least 1.5 Tesla. A majority of the magnetic flux passes through the yoke body 204. As shown with respect to the upper portion 231, the magnetic flux of the field passes from the pole 250 through the transition region 218 in a direction along a plane formed by the X and Y axes (FIG. 2), then through the radial portion 222 in a direction along the central axis 236. The magnetic flux then returns through the transition region 216 and the pole 248.

When the cyclotron 200 is in operation, a portion of the magnetic field escapes the yoke body 204 into regions where the magnetic field is not wanted (i.e., stray fields). The stray fields may be generated proximate to regions of the yoke body 204 where an amount of material (e.g., iron) within the yoke body 204 is not sufficient to contain the magnetic flux. In other words, stray fields may be generated where a cross-sectional area of the yoke body 204 that is transverse (perpendicular) to the direction of the magnetic field has dimensions that are not sufficient for containing the magnetic flow (B). As shown in FIG. 5, cross-sectional areas of the yoke body 204 that may affect the magnetic flow (B) therethrough may be found within the transition regions 216 and 218, the radial portion 222, and portions or regions of the yoke body 204 that extend along the central axis 236 to the corresponding side 208 or 210.

Each of the transition regions 216 and 218, the radial portion 222, and portions or regions between the coil cavities and corresponding sides may have a least cross-sectional area that affects the capability of the yoke body 204 to contain the magnetic flux within that region. The least cross-sectional area may be determined by locating a shortest thickness between the exterior surface 205 and an interior surface of the yoke body 204. For example, a least cross-sectional area of the yoke body 204 may be found where a thickness $T_6$ proximate to the side 208 extends from a point within a cavity surface 271 of the coil cavity 270 to a nearest point along the side surface 209. Although FIG. 5 shows only one cross-section of the yoke body 204, the least cross-sectional area associated with a thickness $T_6$ may be substantially uniform as the yoke body 204 encircles the central axis 236. Furthermore, a least cross-sectional area of the transition region 218 may be found where a thickness $T_5$ of the transition region 218 is measured. For instance, the thickness $T_5$ may be measured from another point in the cavity surface 271 of the coil cavity 270 to a nearest portion of the corner surface 219. Likewise, the least cross-sectional area associated with the thickness $T_5$ may be substantially uniform as the yoke body 204 encircles the central axis 236. A least cross-sectional area of the radial portion 222 may be found where a thickness $T_4$ of the radial portion 222 is measured. The thickness $T_4$ may be measured from a point along the inner radial surface 225 of the acceleration chamber 206 to a nearest point of the outer radial surface 223. In some embodiments, the least cross-sectional area associated with the thickness $T_4$ may be substantially uniform throughout the yoke body 204.

However, in other embodiments, the radial portion 222 may include cavities, passages, and/or recesses that affect the cross-sectional area of the radial portion 222. For example, the radial portion 222 includes the PA cavity 282 (FIG. 2) and the shield recess 262 (FIG. 2) where the cross-sectional area of the radial portion 222 is affected. The PA cavity 282 and the shield recess 262 may be sized and shaped such that the material removed from the yoke body 204 does not significantly affect the magnetic flow (B) of the yoke body 204 or generate further stray fields. The PA cavity 282 and the shield recess 262 may also be located within the radial portion 222 such that electronic equipment or biomedical devices will not be located nearby. For example, the PA cavity 282 may be located at a bottom of the yoke body 204 between the acceleration chamber and the platform 220 (FIG. 3). The shield recess 262 may be located adjacent to a shield (not shown) for the target assembly.

The least cross-sectional areas associated with the thicknesses $T_4$, $T_5$, and $T_6$ may significantly affect an amount or strength of stray fields proximate to the exterior surface 205 of the yoke body 204. As such, the radial portion 222, the transition region 218, and the portion of the yoke body 204 extending between the cavity surface 271 and the side 208 may all be dimensioned so that the stray fields do not exceed a predetermined amount at a predetermined distance from the exterior surface 205. The distances $D_4$, $D_5$, and $D_6$ represent the predetermined distance for the corresponding least cross-sectional areas. The distances $D_4$, $D_5$, and $D_6$ may be measured away from the corresponding surfaces 223, 219, and 209 (i.e., a shortest distance away from a point outside of the yoke body to the corresponding surface). For example, a digital hall effect teslameter (Gaussmeter) manufactured by Group 3 may be used. However, other devices or methods for measuring stray fields may be used. With respect to the radial surface 223, the stray fields may be measured radially outward from the radial surface 223 along a line tangent to the exterior surface.

By way of example, the least cross-sectional areas associated with the thicknesses $T_4$, $T_5$, and $T_6$ may be dimensioned such that the stray fields do not exceed 5 Gauss at a distance of 1 meter from the exterior surface 205. More specifically, the least cross-sectional areas associated with the thicknesses $T_4$, $T_5$, and $T_6$ may be dimensioned such that the stray fields do not exceed 5 Gauss at a distance of 0.2 meter from the exterior surface 205. In the above examples, the average magnetic field strength between the pole tops 252 and 254 may be at least 1 Tesla or at least 1.5 Tesla. In some embodiments, $D_4$, $D_5$, and $D_6$ are approximately equal. Furthermore, in some embodiments, the largest distance of the distances $D_4$, $D_5$, and $D_6$ may be less than 0.2 meters.

Figure 6:
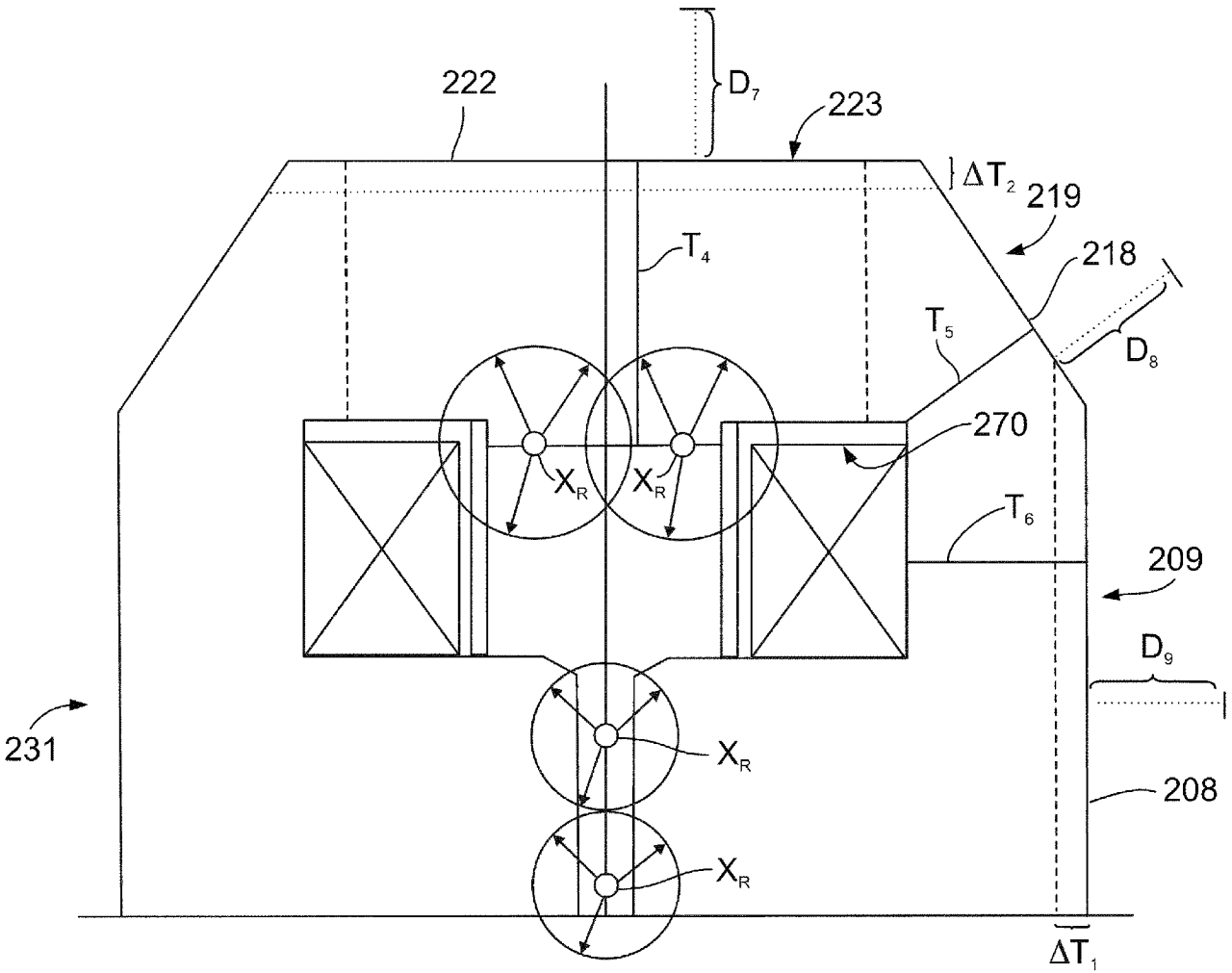
FIG. 6 is a side view of the top portion of the cyclotron in FIG. 3 illustrating radiation emitting from the cyclotron during operation.

FIG. 6 is a side view of the upper portion 231 illustrating radiation being emitted during operation of the cyclotron 200 (FIG. 3). The cyclotron 200 may be separately configured to attenuate radiation emitted from the acceleration chamber 206 (FIG. 3). However, the cyclotron 200 may also be configured to attenuate radiation and to reduce the strength of the stray fields. Two types of radiation that users of the cyclotron 200 may be concerned with are generated within the acceleration chamber 206 when particles collide with material therein. The first type of radiation is from neutron flux. In a particular embodiment, the cyclotron 200 is operated at a low energy such that radiation from the neutron flux does not exceed a predetermined amount outside of the yoke body. For example, the cyclotron may be operated to accelerate the particles to an energy level of approximately 9.6 MeV or less. More specifically, the cyclotron may be operated to accelerate the particles to an energy level of approximately 7.8 MeV or less.

The second type of radiation, gamma rays, is produced when neutrons collide with the yoke body 204. FIG. 6 illustrates several points $X_R$ where particles generally collide with the yoke body 204 when the cyclotron 200 is in operation. The gamma rays emit from the corresponding points $X_R$ in an isotropic manner (i.e., away from the corresponding point $X_R$ in a spherical manner). The dimensions of the yoke body 204 may be sized to attenuate the radiation of the gamma rays. As such, the yoke body 204 may be manufactured to attenuate the radiation from the gamma rays so that any additional shielding used may be manufactured with substantially less material than known shielding systems for cyclotrons.

For example, FIG. 6 shows the thicknesses $T_4$, $T_5$, and $T_6$ that extend through the radial portion 222, the transition region 218, and the portion of the yoke body 204 that extends from the coil cavity 270 to the side 208, respectively. The thicknesses $T_4$, $T_5$, and $T_6$ may be sized so that the dose rate within a desired distance from the exterior surface 205 (or at the exterior surface 205) is below a predetermined amount. Distances $D_7$-$D_9$ represent predetermined distances away from the exterior surface 205 in which the radiation sustained is below a desired dose rate. Each distance $D_7$-$D_9$ from the exterior surface 205 may be a shortest distance to the exterior surface 507 from a point outside of the yoke body 204.

Accordingly, the thicknesses $T_4$, $T_5$, and $T_6$ may be sized so that the dose rate outside of the yoke body 204 does not exceed a desired amount within a desired distance when the target current operates at a predetermined current. By way of example, the thicknesses $T_4$, $T_5$, and $T_6$ may be sized so that the dose rate does not exceed 2 μSv/h at a distance of less than about 1 meter from the corresponding surface at a target current from about 20 to about 30 μA. Furthermore, the thicknesses $T_4$, $T_5$, and $T_6$ may be sized so that the dose rate does not exceed 2 μSv/h at a point along the corresponding surface (i.e., $D_4$, $D_5$, and $D_6$ equal approximately zero) at a target current from about 20 to about 30 μA. However, the dose rate may be directly proportional to the target current. For example, the dose rate may be 1 μSv/h at a point along the corresponding surface when the target current is 10-15 μA.

The dose rate may be determined by using known methods or devices. For example an ion chamber or Geiger Muller (GM) tube based gamma survey meter could be used to detect the gammas. The neutrons may be detected using a dedicated neutron monitor usually based on detectable gammas coming from the neutrons interacting with a suitable material (e.g., plastic) around an ion chamber or GM tube.

In accordance with one embodiment, the dimensions of the yoke body 204 are configured to limit or reduce the stray fields around the yoke body 204 and to reduce the radiation emitted from the cyclotron 200. A maximum magnetic flow (B) that can be achieved by the cyclotron 200 with respect to the magnetic fields through the yoke body 204 may be based upon (or significantly determined by) the least cross-sectional area of the yoke body 204 found along the thickness $T_5$. As such, the size of other cross-sectional areas within the yoke body 204, such as cross-sectional areas associated with the thicknesses $T_4$ and $T_6$, may be determined based upon the cross-sectional area with the transition region 218. For example, in order to reduce the weight of the magnet yoke, conventional cyclotrons typically reduce the cross-sectional areas $T_4$ and $T_6$ until any further reduction would substantially affect the maximum magnetic flow (B) of the cyclotron.

However, the thicknesses $T_4$, $T_5$, and $T_6$ may be based upon not only a desired magnetic flow (B) through the yoke body 204 but also a desired attenuation of the radiation. As such, some portions of the yoke body 204 may have excess material with respect to an amount of material necessary to achieve a desired average magnetic flow (B) through the yoke body 204. For example, the cross-sectional area of the yoke body 204 associated with the thickness $T_6$ may have an excess thickness of material (indicated as $\Delta T_1$). The cross-sectional area of the yoke body 204 associated with the thickness $T_4$ may have an excess thickness of material (indicated as $\Delta T_2$). Accordingly, embodiments described herein may have a thickness, such as the thickness $T_5$, that is defined to maintain magnetic flow (B) below an upper limit and another thickness, such as the thicknesses $T_6$ and $T_4$, that is defined to attenuate the gamma rays that are emitted from within the acceleration chamber.

Furthermore, dimensions of the yoke body 204 may be based upon the type of particles used within the acceleration chamber and the type of material within the acceleration chamber 206 that the particles collide with. Furthermore, dimensions of the yoke body 204 may be based upon the material that comprises the yoke body. Also, in alternative embodiments, an outer shield may be used in conjunction with the dimensions of the yoke body 204 to attenuate both the magnetic stray fields and the radiation emitting from within the yoke body 204.

Figure 7:
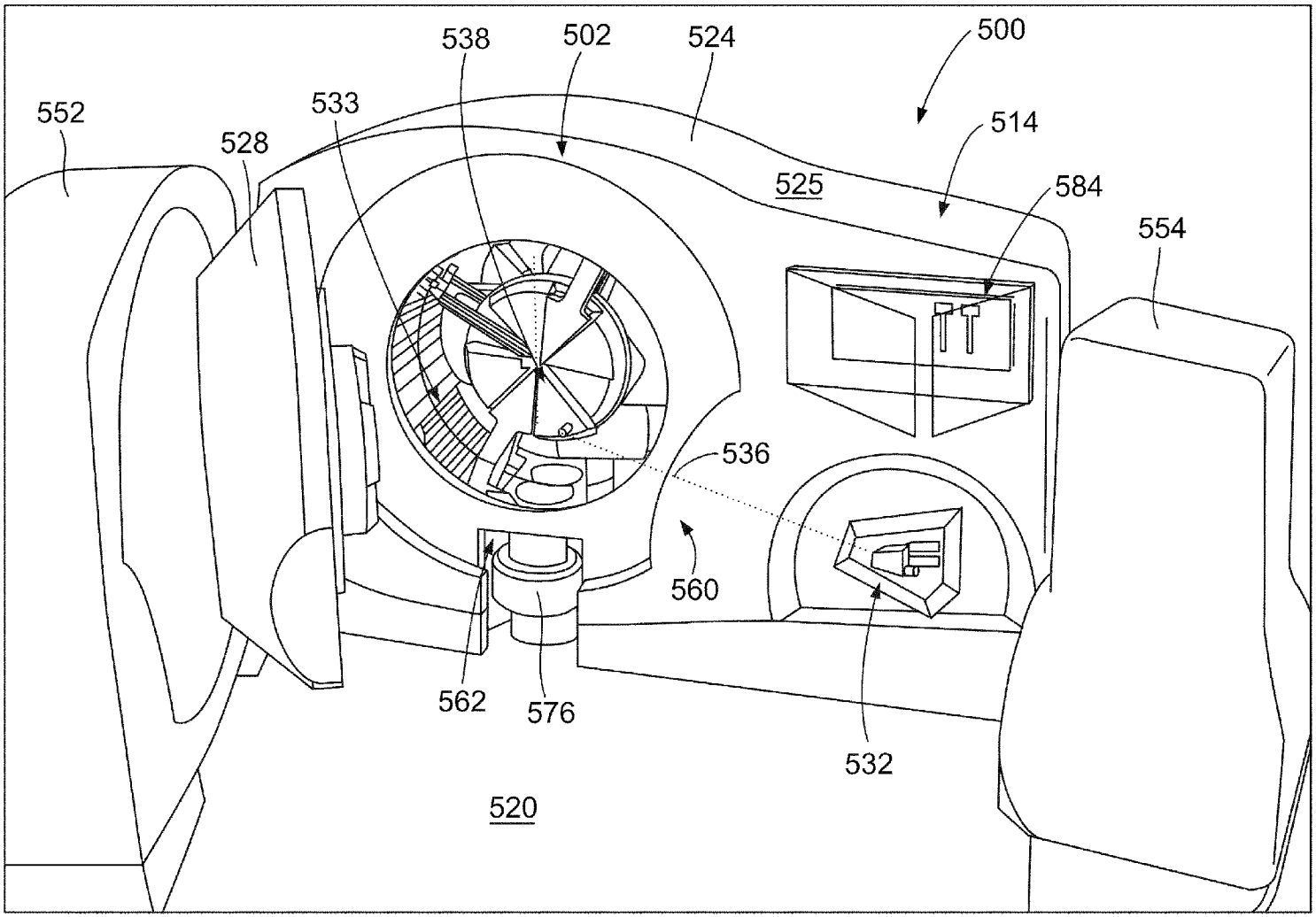
FIG. 7 is a perspective of an isotope production system formed in accordance with another embodiment.

FIG. 7 is a perspective view of an isotope production system 500 formed in accordance with one embodiment. The system 500 is configured to be used within a hospital or clinical setting and may include similar components and systems used with the system 100 (FIG. 1) and the cyclotron 200 (FIGS. 2-6). The system 500 may include a cyclotron 502 and a target system 514 where radioisotopes are generated for use with a patient. The cyclotron 502 defines an acceleration chamber 533 where charged particles move along a predetermined path when the cyclotron 502 is activated. When in use, the cyclotron 502 accelerates charged particles along a predetermined or desired beam path 536 and directs the particles into a target array 532 of the target system 514. The beam path 536 extends from the acceleration chamber 533 into the target system 514 and is indicated as a hashed-line.

FIG. 8 is a cross-section of the cyclotron 502. As shown, the cyclotron 502 has similar features and components as the cyclotron 200 (FIG. 3). However, the cyclotron 502 includes a magnet yoke 504 that may comprise three sections 528-530 sandwiched together. More specifically, the cyclotron 502 includes a ring section 529 that is located between yoke sections 528 and 530. When the ring and yoke sections 528-530 are stacked together as shown, the yoke sections 528 and 530 face each other across a mid-plane 534 and define an acceleration chamber 506 of the magnet yoke 504 therein. As shown, the ring section 529 may define a passage $P_3$ that leads to a port 578 of a vacuum pump 576. The vacuum pump 576 may have similar features and components as the vacuum pump 276 (FIG. 3) and may be a turbomolecular pump, such as the turbomolecular pump 376 (FIG. 4).

Also shown, the cyclotron may include a shroud or shield 524 that surrounds the cyclotron 502. The shield 524 may have a thickness $T_S$ and an outer surface 525. The shield 524 may be fabricated from polyethylene (PE) and lead and the thickness $T_S$ may be configured to attenuate neutron flux from the cyclotron 102. Both the exterior surface 205 and the outer surface 525 may separately represent an exterior boundary of the cyclotron 200. As used herein, the "exterior boundary" includes one of the exterior surface 205 of the yoke body 204, the outer surface 525 of the shield 524, and an area of the cyclotron 200 that may be touched by a user when the cyclotron 200 is fully formed, in a closed position, and in operation. Thus, in addition to the other dimensions of the magnet yoke 202 (FIG. 2), the shield 524 may be sized and shaped to achieve desired attenuation of radiation and a desired reduction in stray fields. For example, the dimensions of the yoke body 204 and the dimensions of the shield 524 (e.g., the thickness $T_S$) may be configured so that the dose rate does not exceed 2 μSv/h at a distance of less than about 1 meter from the outer surface 525 and, more specifically, at a distance of 0 meters. Also, the yoke body 204 and the dimensions of the shield 524 may be sized and shaped such that the stray fields do not exceed 5 Gauss at a distance of 1 meter from the outer surface 525 or, more specifically, at a distance of 0.2 meters.

Returning to FIG. 7, system 500 the shield 524 may include moveable partitions 552 and 554 that open up to face each other. As shown in FIG. 7, both of the partitions 552 and 554 are in an open position. When closed, the partition 554 may cover the target array 532 and a user interface 558 of the target system 514. The partition 552 may cover the cyclotron 502 when closed.

Also shown, the yoke section 528 of the cyclotron 502 may be moveable between open and closed positions. (FIG. 7 illustrates an open position and FIG. 8 illustrates a closed position.) The yoke section 528 may be attached to a hinge (not shown) that allows the yoke section 528 to swing open like a door or a lid and provide access to the acceleration chamber 533. The yoke section 530 (FIG. 9) may also be moveable between open and closed positions or may be sealed to or integrally formed with the ring section 529 (FIG. 9).

Furthermore, the vacuum pump 576 may be located within a pump chamber 562 of the ring section 529 and the housing 524. The pump chamber 562 may be accessed when the partition 552 and the yoke section 528 are in the open position. As shown, the vacuum pump 576 is located below a central region 538 of the acceleration chamber 533 such that a vertical axis extending through a center of the port 578 from a horizontal support 520 would intersect the central region 538. Also shown, the yoke section 528 and ring section 529 may have a shield recess 560. The beam path 536 extends through the shield recess 560.

Figure 9A:
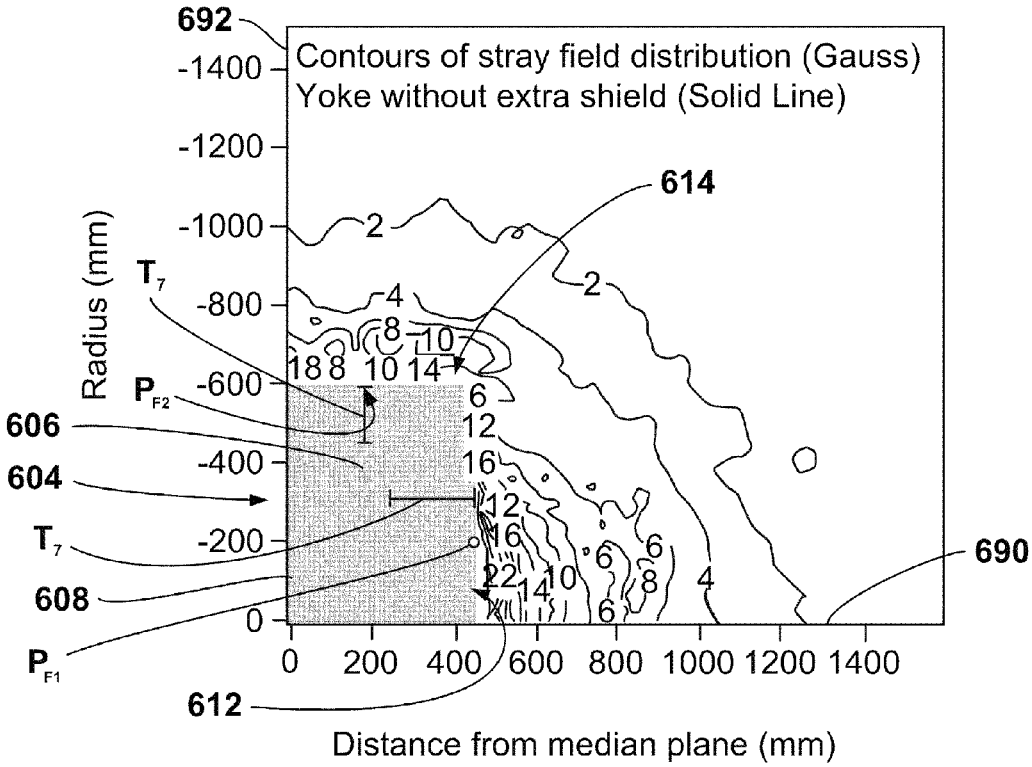
FIG. 9A illustrates a magnetic stray field distribution around a portion of a magnet yoke formed in accordance with one embodiment.
Figure 9B:
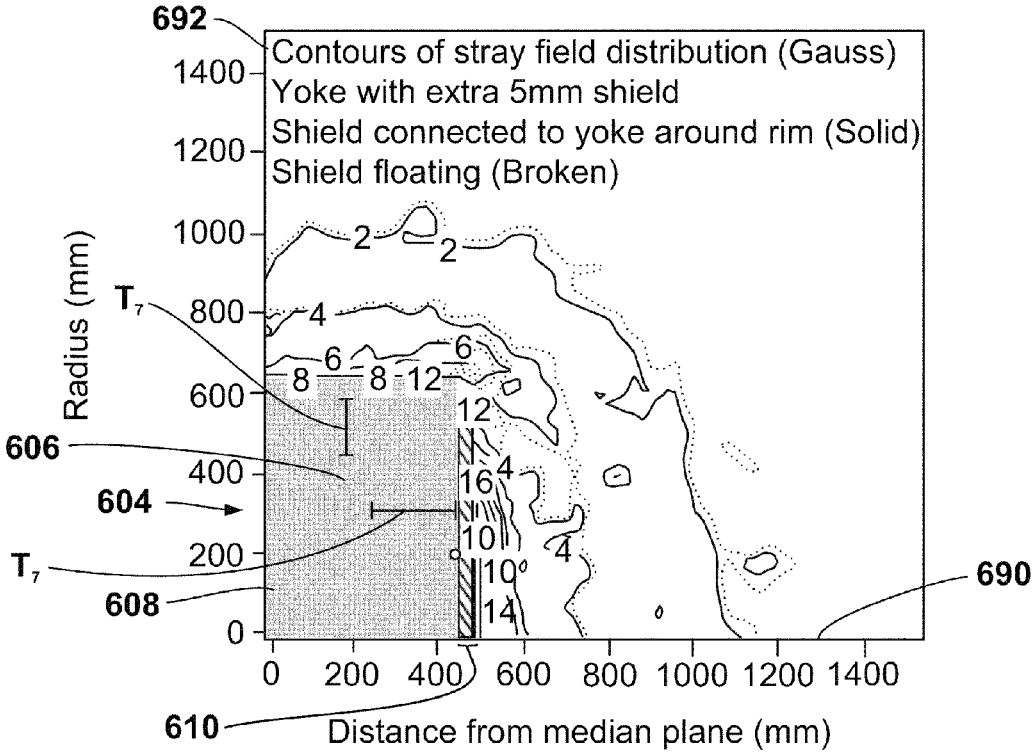
FIG. 9B illustrates a magnetic stray field distribution around the portion of the magnet yoke shown in FIG. 9A when the magnet yoke has a shield surrounding the portion.

FIGS. 9A and 9B illustrate effects that a shroud or shield 610 (FIG. 9B) may have on magnetic stray fields emitting from a cyclotron formed in accordance with embodiments described herein. FIGS. 9A and 9B show magnetic stray field distributions from a geometric center (indicated by point (0,0)) of a portion of a magnet yoke 604. In FIGS. 9A and 9B, the axis 690 shows the distance (mm) away from a median plane of the magnet yoke 604 and an axis 692 shows the distance (mm) away from the center along the median plane. FIG. 9A illustrates the magnetic stray field distribution without a shield, and FIG. 9B illustrates the magnetic stray field distribution with the shield 610 adjacent to a planar side surface 612 of the magnet yoke 604. The magnet yoke 604 had a thickness $T_7$ of about 200 mm. A cross-section of a magnet coil 606 and a portion of a pole 608 are also shown.

With respect to FIG. 9A, the magnetic stray field at a point $P_{F1}$ immediately outside of the magnet yoke 604 (i.e., along the planar side surface 612 of the magnet yoke 604) is about 40 G (Gauss) at full excitation, while the magnetic stray field at a point $P_{F2}$ immediately outside a radial surface 614 or circular periphery is 10 G. The magnetic stray field is about 5 G when about 500 mm away from the planar side surface 612 and about 200 mm away from the radial surface 614.

FIG. 9B shows the magnetic stray field distribution with the magnet yoke 604 having the shield 610 surrounding at least a portion of the magnet yoke 604. The shield 610 includes 5 mm thickness of iron that is separated from the magnet yoke 604 by 10 mm of a non-magnetic material. The shield 610 may be directly attached to the surfaces 612 and 614 or may be slightly spaced apart from the magnet yoke 604. As shown in FIG. 9B, the shield 610 reduces the distance that the magnetic stray fields extend away from the median plane (i.e., along the axis 690). More specifically, the 5 G limit is reduced from 500 mm away from the planar surface 612 to about 200 mm away. Furthermore, as shown by comparing FIGS. 9A and 9B, spacing between the iso-lines for the magnetic stray fields at 6 G or greater are significantly reduced (i.e., packed together) and the spacing between the iso-lines for 4 G or smaller are increased (i.e., spaced further apart). Accordingly, the shield 610 affects the magnetic stray field distribution away from the planar surface 612 so that the magnetic stray fields may be reduced to a predetermined level at a predetermined distance (e.g., 200 mm or less).

Embodiments described herein are not intended to be limited to generating radioisotopes for medical uses, but may also generate other isotopes and use other target materials. Furthermore, in the illustrated embodiment the cyclotron 200 is a vertically-oriented isochronous cyclotron. However, alternative embodiments may include other kinds of cyclotrons and other orientations (e.g., horizontal).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cyclotron, comprising:

a magnet yoke having a yoke body surrounding an acceleration chamber, the yoke body having an exterior surface; and a magnet assembly configured to produce magnetic fields to direct charged particles along a desired path, the magnet assembly located in the acceleration chamber, the magnetic fields propagating through the acceleration chamber and within the magnet yoke, wherein a portion of the magnetic fields escapes outside the exterior surface as stray fields, the exterior surface facing away from the acceleration chamber to an exterior of the cyclotron, wherein the magnet yoke is dimensioned such that the stray fields do not exceed 5 Gauss at a distance of 1 meter from the exterior surface.

2. The cyclotron of claim 1 wherein the yoke body comprises opposing pole tops having a space therebetween where the charged particles are directed along the desired path, wherein the average magnetic field strength between the pole tops is at least 1 Tesla.

3. The cyclotron of claim 2 wherein the magnet yoke is dimensioned such that the stray fields do not exceed 5 Gauss at a distance of 0.2 meters from the exterior surface.

4. The cyclotron of claim 1 further comprising a cyclotron shield that surrounds the magnet yoke having an outer surface that faces the exterior of the cyclotron, the exterior surface facing the cyclotron shield, the magnet yoke and the cyclotron shield being dimensioned such that the stray fields do not exceed 5 Gauss at a distance of 0.2 meters as measured from the outer surface of the cyclotron shield.

5. The cyclotron of claim 1, wherein the yoke body includes longitudinally spaced ends and laterally spaced sides, the sides extending parallel to a mid-plane of the magnet yoke, the charged particles configured to orbit along the mid-plane, wherein the stray fields do not exceed 5 Gauss at a distance of 1 meter from the exterior surface along at least one of the sides.

6. The cyclotron of claim 1, wherein the yoke body is formed with a hollow disk shape oriented along a cyclotron mid-plane, the exterior surface being circular extending about the disk shape, the stray fields being measured radially outward from the circular exterior surface along a line tangent to the circular exterior surface.

7. The cyclotron of claim 1, wherein the yoke body includes an interior surface, the yoke body having multiple radial thicknesses separating the interior and exterior surfaces, the multiple radial thicknesses being associated with different cross-sectional areas of the yoke body that are substantially transverse to a magnetic flow (B), wherein a first radial thickness of a first cross-sectional area is defined to maintain a magnetic flow (B) below an upper limit, wherein a a second radial thickness of a second cross-sectional area is defined to limit the gamma attenuation to a predetermined gamma attenuation limit, the second radial thickness being greater than necessary to maintain the magnetic flow (B) below the upper limit.

8. The cyclotron of claim 7, wherein the magnet assembly includes a pair of opposing magnet coils spaced apart from each other across a mid-plane of the magnet yoke, the magnet coils being located within corresponding coil cavities within the yoke body, wherein the first radial thickness extends from a corresponding coil cavity to a nearest point along the exterior surface of the magnet yoke.

9. A method of manufacturing a cyclotron configured to generate magnetic and electric fields for directing charged particles along a desired path, comprising:

providing a magnet yoke having a yoke body that surrounds an acceleration chamber, wherein the magnetic fields are generated therein to direct the charged particles, the magnet yoke being dimensioned such that stray fields escaping an exterior surface of the magnet yoke do not exceed a predetermined amount at a predetermined distance from the exterior surface, the exterior surface facing away from the acceleration chamber to an exterior of the cyclotron; and locating a magnet assembly in the acceleration chamber, the magnet assembly configured to produce the magnetic fields, wherein the magnet assembly is configured to operate and the magnet yoke is dimensioned so that the stray fields do not exceed 5 Gauss at a distance of 1 meter from the exterior surface.

10. The method of claim 9 wherein the yoke body comprises opposing pole tops having a space therebetween where the charged particles are directed along the desired path, wherein the average magnetic field strength between the pole tops is at least 1 Tesla.

11. The method of claim 10 wherein the magnet yoke is dimensioned such that the stray fields do not exceed 5 Gauss at a distance of 0.2 meters from the exterior surface.

12. The method of claim 9 further comprising a cyclotron shield having an outer surface that faces the exterior of the cyclotron and that surrounds the magnet yoke, the exterior surface facing the cyclotron shield, the magnet yoke being dimensioned such that the stray fields do not exceed 5 Gauss at a distance of 0.2 meters as measured from the outer surface of the cyclotron shield.

13. The method of claim 9, wherein the yoke body includes an interior surface, the yoke body having multiple radial thicknesses separating the interior and exterior surfaces, the multiple radial thicknesses being associated with different cross-sectional areas of the yoke body that are transverse to a magnetic flow (B), wherein a first radial thickness of a first cross-sectional area is defined to maintain magnetic flow (B) below an upper limit, wherein a second radial thickness of a second cross-sectional area is defined to limit the gamma attenuation to a predetermined gamma attenuation limit, the second radial thickness being greater than necessary to maintain the magnetic flow (B) below the upper limit.

14. The method of claim 13, wherein the magnet assembly includes a pair of opposing magnet coils spaced apart from each other across a mid-plane of the magnet yoke, the magnet coils being located within corresponding coil cavities within the yoke body, wherein the first radial thickness extends from a corresponding coil cavity to a nearest point along the exterior surface of the magnet yoke.

15. The cyclotron of claim 1, wherein the magnet yoke includes a shield recess that is sized and shaped to receive a radiation shield of a target assembly, the shield recess extending inward toward the acceleration chamber.

16. The cyclotron of claim 1, wherein the yoke body comprises opposing pole tops having a space therebetween where the charged particles are directed along the desired path, wherein the average magnetic field strength between the pole tops is at least 1 Tesla when the charged particles are accelerated to an energy level of approximately 9.6 MeV or less.

17. The cyclotron of claim 1, wherein the stray fields do not exceed 5 Gauss at a distance of 1 meter from the exterior surface at an external point, the external point being accessible to an individual during operation of the cyclotron.

18. The method of claim 9, wherein the yoke body includes longitudinally spaced ends and laterally spaced sides, the sides extending parallel to a mid-plane of the magnet yoke, the charged particles configured to orbit along the mid-plane, wherein the stray fields do not exceed 5 Gauss at a distance of 1 meter from the exterior surface along at least one of the sides.

19. A cyclotron, comprising:

a magnet yoke having a yoke body surrounding an acceleration chamber;

a magnet assembly configured to produce magnetic fields to direct charged particles along a desired path, the magnet assembly located in the acceleration chamber, the magnetic fields propagating through the acceleration chamber and within the magnet yoke, wherein a portion of the magnetic fields escapes outside an exterior surface of the magnet yoke as stray fields, the exterior surface facing away from the acceleration chamber to an exterior of the cyclotron; and a cyclotron shield that surrounds the magnet yoke and that has an outer surface facing the exterior of the cyclotron, the exterior surface facing the cyclotron shield, the magnet yoke and the cyclotron shield being dimensioned such that the stray fields do not exceed 5 Gauss at a distance of 0.5 meters from the outer surface of the cyclotron shield at an external point, the external point being accessible to an individual during operation of the cyclotron.

20. The cyclotron of claim 19 wherein the stray fields do not exceed 5 Gauss at a distance of 0.2 meters from the outer surface of the cyclotron shield at the external point.

21. The cyclotron of claim 19 wherein the cyclotron shield is adjacent to the exterior surface such that the cyclotron shield is directly attached to the exterior surface or slightly spaced apart from the exterior surface.

* * * * *